US007384184B2

(12) United States Patent
Melander et al.

(10) Patent No.: US 7,384,184 B2
(45) Date of Patent: Jun. 10, 2008

(54) APPARATUS FOR MIXING A CHEMICAL MEDIUM WITH A PULP SUSPENSION

(75) Inventors: Olof Melander, Sundsvall (SE); Peter Danielsson, Fagervik (SE); Tomas Wikström, Sundsvall (SE)

(73) Assignee: Metso Paper, Inc. (FI)

( * ) Notice: Subject to any disclaimer, the term of this patent is extended or adjusted under 35 U.S.C. 154(b) by 246 days.

(21) Appl. No.: 10/537,938

(22) PCT Filed: Dec. 8, 2003

(86) PCT No.: PCT/SE03/01906

§ 371 (c)(1),
(2), (4) Date: Oct. 27, 2005

(87) PCT Pub. No.: WO2004/052516

PCT Pub. Date: Jun. 24, 2004

(65) Prior Publication Data

US 2006/0133195 A1 Jun. 22, 2006

(30) Foreign Application Priority Data

Dec. 12, 2002 (SE) ..... 0203677

(51) Int. Cl.
*B01F 7/04* (2006.01)
*B01F 15/02* (2006.01)

(52) U.S. Cl. ..... 366/170.3; 366/171.1; 366/172.1; 366/307; 366/325.2

(58) Field of Classification Search ..... 366/168.1, 366/172.1, 172.2, 171.1, 325.2, 306–307, 366/170.3; 162/243, 57
See application file for complete search history.

(56) References Cited

U.S. PATENT DOCUMENTS 3,503,846 A * 3/1970 Nardi ..... 162/236

(Continued)

FOREIGN PATENT DOCUMENTS

EP 297464 A2 * 1/1989

(Continued)

OTHER PUBLICATIONS

Sunds Defibrator AB's Marknadsforingsmaterial SMA Mixers (tryckt av Reklammakarna/Tryckeribolaget Sundsvall AB 1984.

(Continued)

*Primary Examiner*—Charles E. Cooley
(74) *Attorney, Agent, or Firm*—Lerner, David, Littenberg, Krumholz & Mentlik, LLP

(57) ABSTRACT

Apparatus for mixing a chemical medium with a pulp suspension is disclosed, comprising a housing, a first feeder for feeding the pulp suspension to a mixing chamber, a rotor body connected to a rotor shaft to supply kinetic energy to the pulp suspension flow, such that turbulence is produced in a turbulent flow zone in the mixing chamber, a second feeder for feeding the chemical medium to the mixing chamber, and a flow-restraining disk in the outlet from the mixing chamber with flow passages arranged to temporarily increase the flow velocity of the pulp suspension, the second feeder comprising a chemical distribution element integrated with the rotor body to distribute the chemical medium close to the turbulent flow zone, and the rotor body comprising a number of rotor pins which extend from the rotor shaft.

20 Claims, 5 Drawing Sheets

U.S. PATENT DOCUMENTS

| | | | | |
|---|---|---|---|---|
| 4,339,206 | A | 7/1982 | Ahs | |
| 4,416,548 | A | 11/1983 | Carre et al. | |
| 4,577,974 | A | 3/1986 | Prough et al. | |
| 4,877,368 | A * | 10/1989 | Timperi et al. | 415/143 |
| 5,088,831 | A | 2/1992 | Reinhall | |
| 5,263,774 | A * | 11/1993 | Delcourt | 366/305 |
| 5,271,672 | A * | 12/1993 | Reck | 366/169.2 |
| 5,378,321 | A * | 1/1995 | Delcourt | 162/57 |
| 5,711,852 | A | 1/1998 | Ekholm et al. | |
| 5,791,778 | A * | 8/1998 | Manninen et al. | 366/171.1 |
| 5,813,758 | A * | 9/1998 | Delcourt et al. | 366/171.1 |
| 5,863,120 | A | 1/1999 | Gallagher et al. | |
| 6,254,335 | B1 | 7/2001 | Ekholm et al. | |
| 2006/0133195 | A1* | 6/2006 | Melander et al. | 366/170.3 |
| 2006/0140049 | A1* | 6/2006 | Melander et al. | 366/171.1 |

FOREIGN PATENT DOCUMENTS

| | | |
|---|---|---|
| EP | 0 664 150 B1 | 7/1995 |
| WO | WO 8700450 A1 * | 1/1987 |

OTHER PUBLICATIONS

Sunds Defibrator AB's Marknadsforungsmaterial SM Mixers (tryckt av Reklammakarna/Tryckeribolaget Sundsvall AB 1989.
Sunds Defibrator AB's Marknadsforingsmaterial SM Mixer (tryckt av Reklammakarna/Tryckeribolaget Sundsvall AB 1990.
Dual Mixers (Kvaerner Pulping AB), date unknown.
TAPPI Chemical Pulping Book 6A, p. A629 (1999).

* cited by examiner

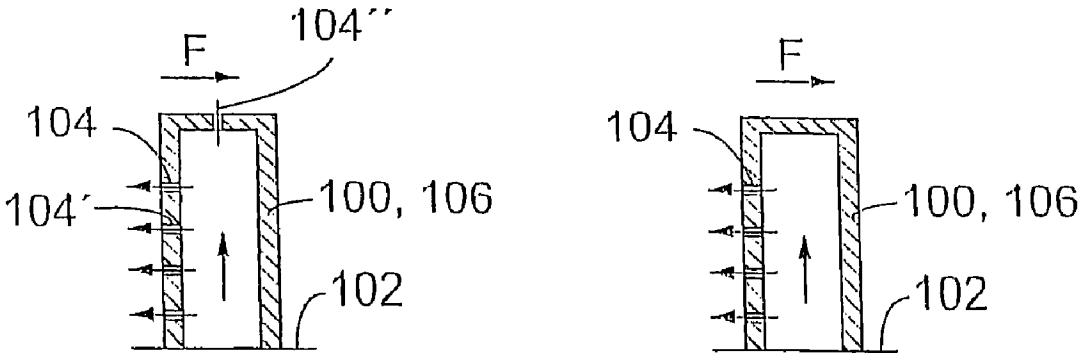
Fig.2
Fig.3
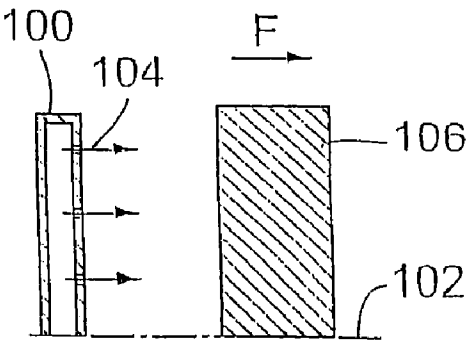
Fig.4

APPARATUS FOR MIXING A CHEMICAL MEDIUM WITH A PULP SUSPENSION

FIELD OF THE INVENTION

The present invention relates to an apparatus for mixing of a chemical medium in gas gaseous or liquid state with a pulp suspension.

BACKGROUND OF THE INVENTION

In the treatment of pulp suspensions there is a need for intermixture of different media for treatment, for example for heating or bleaching purposes. Therefore it is desirable to disperse the medium in the pulp suspension during simultaneous conveyance of the pulp suspension through a pipe. European Patent No. 664,150 discloses apparatus for this function. For heating of pulp suspensions, steam is added which condenses and thus gives off its energy content to the pulp suspension. A bleaching agent is added during bleaching that reacts with the pulp suspension. In connection with the treatment of recovered fiber pulp printing ink is separated by flotation, which means that air must previously be disintegrated in the pulp suspension such that the hydrophobic ink, or the printing ink, may attach to the rising air bubbles. In this connection it is desirable that the medium for treatment, e.g. air, is evenly and homogeneously distributed in the pulp suspension, preferably with tiny bubbles to achieve a large surface against the pulp suspension.

In all cases it is difficult, with proportionately low addition of energy, to achieve an even intermixture of the medium in the flow of material. When heating pulp suspensions by the supply of steam to a pulp pipe, problems often arise with large steam bubbles that are formed on the inside of the pipe, and this as a consequence of a non-disintegrated gas with a small condensation surface. When these large steam bubbles rapidly implode, condensation forces arise that cause vibrations in the pipe, and in the following equipment. This phenomenon limits the amount of steam that can be added to the system and thus the desired increase in temperature. It is hard to achieve a totally even temperature profile in the pulp suspension when large steam bubbles exist. In order to remedy these problems, a large amount of energy can be supplied to carefully admix the steam in the pulp suspension. Another variant is to disintegrate the steam already supplied with the pulp suspension. In the intermixing of bleaching agents in a pulp suspension, relatively large amounts of energy are used in order to provide that the bleaching agent is evenly distributed and conveyed to all the fibers in the pulp suspension. The energy requirements are controlled by which bleaching agent is be supplied (rate of diffusion and reaction velocity) and also by the phase of the bleaching medium (liquid or gas). The geometry during supply of the bleaching agent in vapour phase is important in order to avoid unwanted separation immediately after the intermixture.

One object of the present invention is to provide an apparatus for supplying and intermixing of a chemical medium in a pulp suspension in an effective way and that at least partly eliminates the above mentioned problem.

SUMMARY OF THE INVENTION

These and other objects are achieved with an apparatus for mixing of a chemical medium in gaseous or liquid state with a pulp suspension according to the present invention.

The apparatus comprises a housing having a wall that defines a mixing chamber and a first feeder for feeding the pulp suspension to the mixing chamber. Further, the apparatus comprises a rotor shaft that extends in the mixing chamber, a drive device for rotation of the rotor shaft and a rotor body that is connected to the rotor shaft. The rotor body is arranged to supply kinetic energy to the pulp suspension flow during rotation of the rotor shaft by the rotation of the drive device, such that turbulence is produced in a turbulent flow zone in the mixing chamber. The apparatus also comprises a second feeder for feeding of the chemical medium to the mixing chamber and an outlet for discharging the mixture of chemical medium and pulp suspension from the mixing chamber. The apparatus is characterised by that the second feeder comprises a chemical distribution element integrated with the rotor body and arranged to distribute the chemical medium to or to close vicinity to said turbulent flow zone.

In that respect, in accordance with present invention, an even and effective intermixing of the chemical medium in the pulp suspension is provided.

Further features and advantages according to embodiments of the apparatus according to the present invention are evident from the claims and in the following from the description.

BRIEF DESCRIPTION OF THE DRAWINGS

The present invention shall now be described more in detail in embodiments in the following detailed description, with reference to the accompanying drawings, without restricting the interpretation of the invention thereto, where

FIG. 2 is a side, elevational view of a chemical distribution element according to an embodiment of the present invention;

FIG. 3 is a side, elevational view of another chemical distribution element according to an alternative embodiment of the present invention;

FIG. 4 is a side, elevational view of yet another chemical distribution element according to an alternative embodiment of the present invention;

DETAILED DESCRIPTION

Figures 1A, 1B:
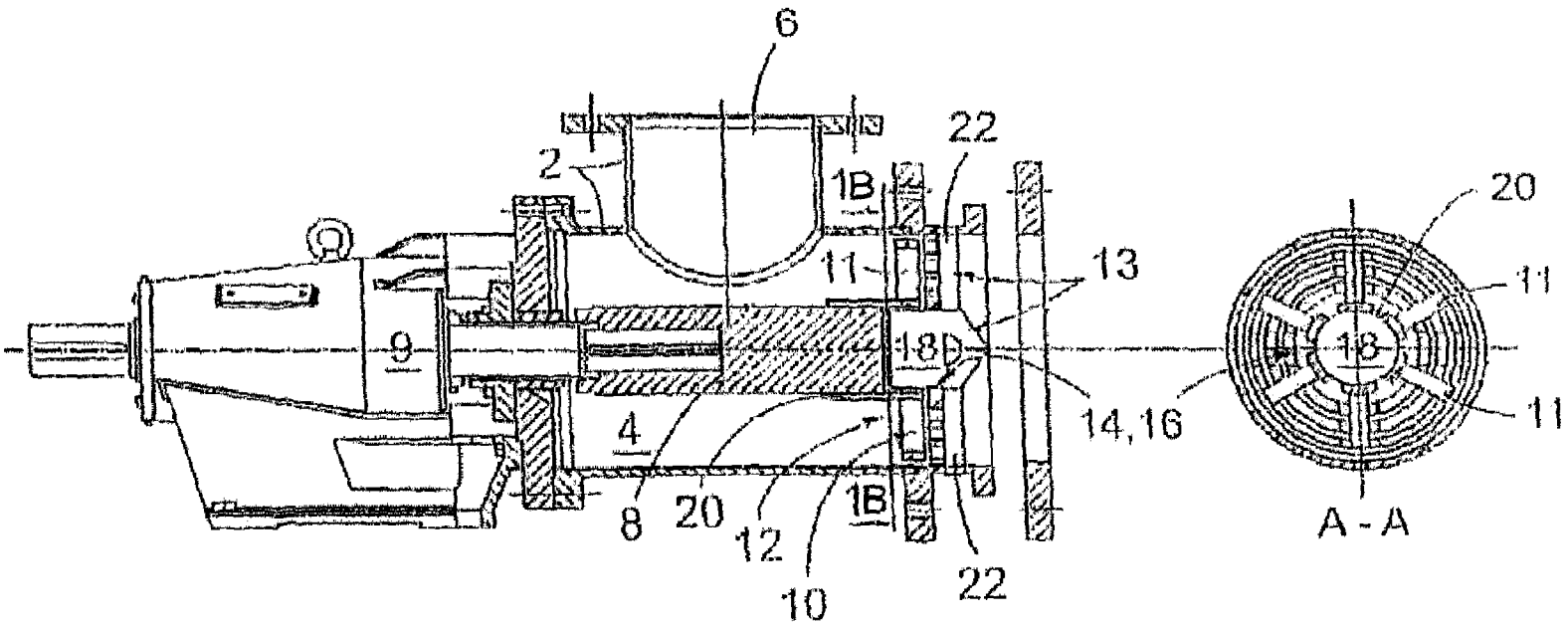
FIG. 1A is a side, elevational, cross-sectional view of an apparatus according to an embodiment of the present invention.
FIG. 1B is a front, elevational, cross-sectional view taken along 1B-1B of the apparatus according to FIG. 1A.

In FIGS. 1A-B is shown an apparatus according to an embodiment of the present invention, for a mixture of a chemical medium in gaseous or liquid state with a pulp suspension. The apparatus comprises a housing with a wall 2 that defines a mixing chamber 4 and a first feeder 6 for supplying a pulp suspension to the mixing chamber. Further, the apparatus comprises a rotor shaft 8, which extends in the mixing chamber 4, a drive device 9 for rotation of the rotor shaft and a rotor body 10 that is connected to the rotor shaft 8. The rotor body is arranged to supply kinetic energy to the pulp suspension flow during rotation of the rotor shaft by the rotation of the drive device, such that turbulence is produced in a turbulent flow zone 12 in the mixing chamber. The apparatus also comprises a second feeder 13 for feeding the chemical medium to the mixing chamber and an outlet (not shown) for discharging the mixture of chemical medium and pulp suspension from the mixing chamber 4. The second feeder 13 comprises a chemical distribution element 14 integrated with the rotor body 10 and arranged to distribute the chemical medium to or in close proximity to the turbulent flow zone 12.

Preferably, the rotor body 10 comprises a number of rotor pins 11, which extend from the rotor shaft 8. The chemical distribution element 14 comprises at least one chemical outlet 16, suitably situated up-stream of the rotor pins.

As is evident from FIGS. 2-4, a chemical distribution element may comprise at least one distribution pipe 100 that extends radially from the rotor shaft 102, whereby chemical outlet(s) 104 is arranged on the distribution pipe 100.

As illustrated in FIG. 4, the chemical outlets 104 may be directed (which is shown by the arrows in FIG. 4) against a rotor pin 106. According to an alternative embodiment of the present invention, as shown in FIGS. 2 and 3, the chemical distribution element may also comprise at least one chemical outlet 104 arranged on at least one of the rotor pins 106. In that respect, the chemical outlet can be directed (as shown by arrows in FIGS. 2 and 3) in the opposite flow direction F from the pulp suspension along the rotor shaft 102, or directed transverse to the flow direction F of the pulp suspension (not shown). As is evident from FIG. 2, the chemical distribution element can comprise a plurality of chemical outlets 104 arranged on at least one of the rotor pins 106, whereby at least one chemical outlet 104' is directed in the opposite flow direction from the pulp suspension along the rotor shaft and at least one chemical outlet 104" is transverse to the flow direction of the pulp suspension from the rotor shaft 102. The chemical outlets 104 may be designed as cylindrical apertures. Other designs, e.g. spray nozzle shapes, can be used in order to improve the chemical distribution and prevent the pulp suspension from penetrating upstream in the chemical outlets 104.

With reference again to FIGS. 1A-B, the second feeder 13 may comprise a stationary cylindrical body 18, which is coaxial with the rotor shaft 8, and the rotor body 10 comprises a sleeve 20 that sealingly surrounds the cylindrical body 18, whereby the cylindrical body is provided with a channel for the chemical medium that communicates with the chemical distribution element 14. The second feeder 13 can suitably comprise a connection pipe 22, that extends through the wall 2 of the housing to the stationary cylindrical body 18 and that is connected to the channel therein.

Figure 5:
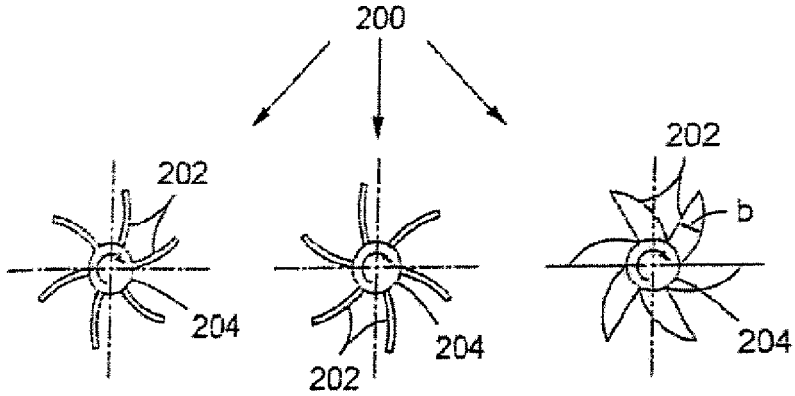
FIG. 5A is a front, elevational, cross-sectional view of one embodiment of a rotor pin in cross-section of the rotor shaft in accordance with the present invention.
FIG. 5B is a front, elevational, cross-sectional view of another embodiment of a rotor pin in cross-section of the rotor shaft in accordance with the present invention.
FIG. 5*c* is a front, elevational, cross-sectional view of another embodiment of a rotor pin in cross-section of the rotor shaft in accordance with the present invention.
Figure 6:
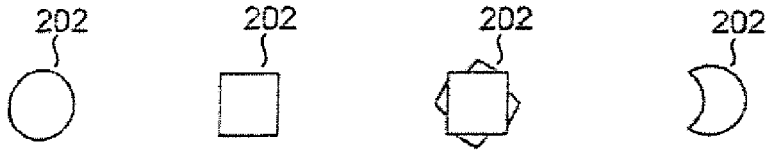
FIG. 6A is a front, elevational, cross-sectional view of one rotor pin according to the present invention.
FIG. 6B is a front, elevational, cross-sectional view of another rotor pin according to the present invention.
FIG. 6C is a front, elevational, cross-sectional view of another rotor pin according to the present invention.
FIG. 6D is a front, elevational, cross-sectional view of another rotor pin according to the present invention.

FIGS. 5A-C illustrate that a rotor body 200 according to the present invention may comprise a number of rotor pins 202, which extends from the rotor shaft 204 in its radial direction. Each rotor pin may be curved forwardly from the rotor shaft (FIG. 5A) or backwardly (FIG. 5B) relative to the rotational direction of the rotor body (see arrow in FIGS. 5A-C), with both embodiments aiming to provide a radial conveyance of the mixture. According to an alternative embodiment shown in FIG. 5C, each rotor pin may have a width b, as seen in the rotational direction of the rotor body, that increases along at least a part of the rotor body in a direction against the rotor shaft 204. The embodiment according to FIG. 5C decreases the opened area and in that manner the axial flow velocity increases. The rotor pins 202 can be provided with varying cross-sections as illustrated in FIGS. 6A-D. Each rotor pin may be designed with a circular cross-section as shown in FIG. 6A, which is simple from a manufacturing viewpoint, and provides a cost efficient design. The rotor pins 202 may also be provided with a triangular or quadratic cross-section, according to FIGS. 6B-C, which geometry creates a dead air space during rotation of the rotor shaft. According to yet an embodiment the rotor pins may be provided with a shovel-shaped cross-section according to FIG. 6D, which results in a sling-effect during rotation of the rotor shaft. In addition, as is evident from FIG. 6C, each rotor pin may be designed with a helix shape, suitably with a quadratic cross-section, in the axial direction of the rotor pin. Which of the various designs of the cross-sections of the rotor pins 202 are most preferable depends on the current flow resistance.

Figure 7:
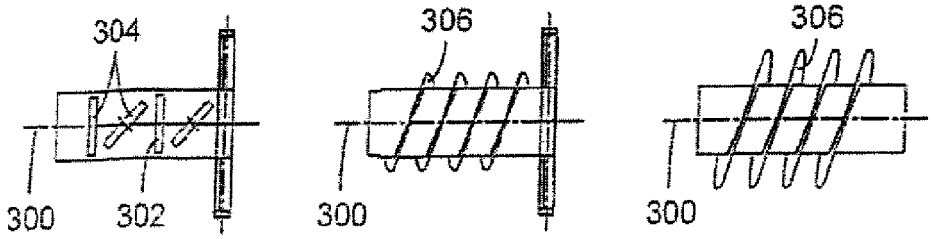
FIG. 7A is a side, elevational, schematic view of one rotor shaft provided with axial flow-generating elements according to the present invention.
FIG. 7B is a side, elevational, schematic view of another rotor shaft provided with axial flow-generating elements according to the present invention.
FIG. 7C is a side, elevational, schematic view of another rotor shaft provided with axial flow-generating elements according to the present invention.

FIGS. 7A-C show alternative embodiments of a rotor shaft 300 provided with one or more axially flow generating elements 302. As is shown in FIG. 7A, the axial flow-generating element can comprise a number of blades 304, which are obliquely attached relative to the rotor shaft. Rotation of the rotor shaft causes an axial flow. If the elements are of various rotational orientations along the rotor shaft, as shown in FIG. 7A, different directions of flow are obtained as well. In addition, the axial flow-generating element can comprise a screw thread or a band thread 306, according to alternative embodiments shown in FIGS. 7B-C, which extend along the rotor shaft 300, that aims to force the fluid closest to the hub of the rotor shaft towards a particular direction. For feeding, the height of the band can suitably be about 5 to 35 mm. According to an alternative embodiment the axial flow-generating element can comprise a relatively thin elevation of about 3 to 6 mm on the surface of the shaft, suitably about 3.8 to 5.9 mm. This scale of lengths is suitable when it corresponds to the characteristic size of the fiber-flocks for kraft pulp at current process conditions. Thus, this should be variable in the process. The size of the flocks can be said to be in inverse proportion to the total work that is added to the fiber suspension.

Figure 8A:
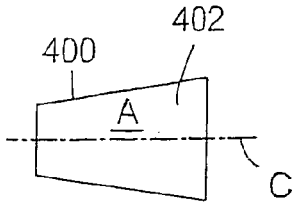
FIG. 8A is a top, elevational, schematic view of one flow passage of a flow-restraining disk according to the present invention.
Figure 8B:
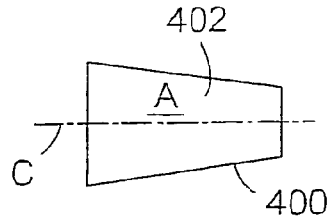
FIG. 8B is a top, elevational, schematic view of another flow passage of a flow-restraining disk according to the present invention.
Figure 8C:
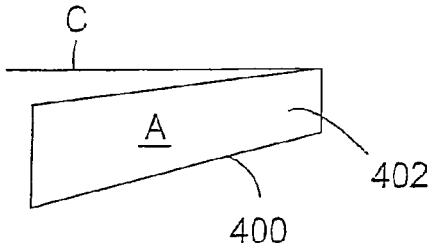
FIG. 8C is a top, elevational, schematic view of another flow passage of a flow-restraining disk according to the present invention.
Figure 8D:
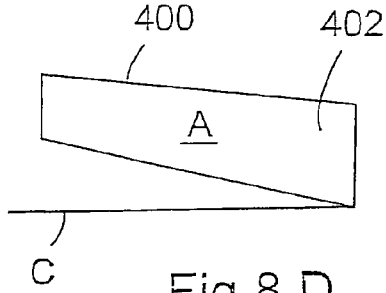
FIG. 8D is a top, elevational, schematic view of another flow passage of a flow-restraining disk according to the present invention.

Preferably, the apparatus comprises a flow-restraining disk 400 with on or more flow passages, having a constant axial area, and arranged to temporarily increase the flow velocity of the pulp suspension when the pulp suspension passes the flow-restraining disk. The purpose of the disk is to create a controlled pressure drop. The energy is used for static mixing and the disk is designed for varying pressure recovery depending on the desired energy level. FIGS. 8A-D show different alternative embodiments of flow passages 402 in the axial direction of a flow-restraining disk 400. The flow area A of each flow passage increases or decreases in the direction of the flow, which in particular is shown in FIGS. 8A-B. FIG. 8A shows a divergent opening, i.e. in which an open area enlarges in the axial direction. FIG. 8B shows a converging opening, i.e. where the open area diminishes in the axial direction. As shown in FIGS. 8C-D, each flow passage can extend obliquely from the up-stream side of the disk against the center axis C of the disk.

Figure 9A:
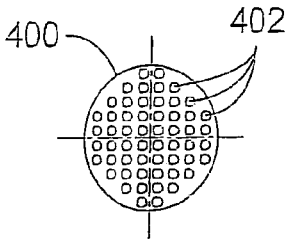
FIG. 9A is a front, elevational view of one pattern of flow passages for a flow-restraining disk according to the present invention.
Figure 9B:
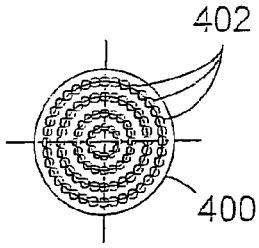
FIG. 9B is a front, elevational view of another pattern of flow passages for a flow-restraining disk according to the present invention
Figure 9C:
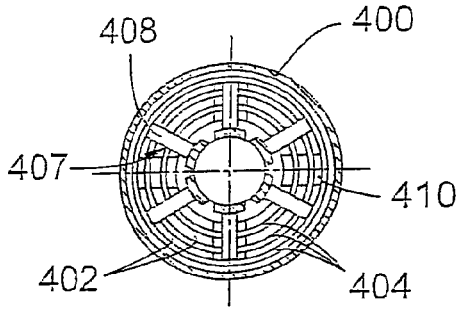
FIG. 9C is a front, elevational view of another flow-restraining disk, in the axial direction, comprising concentrically rings which are coaxial with a rotor shaft.
Figure 9D:
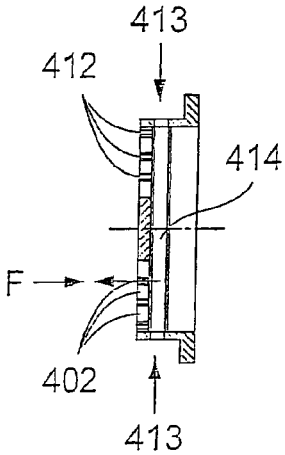
FIG. 9D is a side, elevational, cross-sectional view of another flow-restraining disk comprising channels for chemical distribution in accordance with the present invention.
Figure 9E:
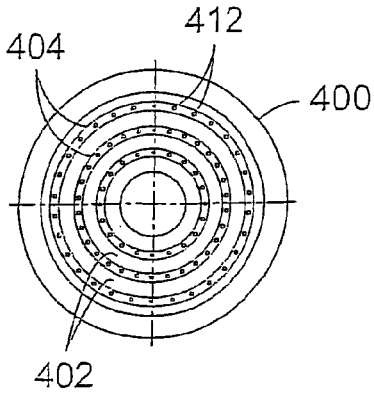
FIG. 9E is a front, elevational view of the disk according to FIG. 9D.

The flow-restraining disk 400 is preferably provided with a plurality of flow passages 402 as shown in FIGS. 9A-C, which passages can be arranged according to a number of alternative placement patterns, radially spread out on the flow-restraining disk. The disk is preferably circular or coaxial with the rotor shaft. The flow passages of the flow-restraining disk may, for example, form a Cartesian pattern (FIG. 9A) which provides asymmetrical jet streams, or a polar pattern (FIG. 9B). FIG. 9C shows an alternative embodiment where the flow passages 402 of the flow-restraining disk 400 in the axial direction are formed of concentrical rings 404 that are coaxial with a rotor shaft 406, and its rotor body 407, which may comprise one or more rotor pins 408, arranged a distance from and ahead of disk 400. The flow-restraining disk is suitably stationarily arranged in the housing, and the disk may comprise a number of concentrical rings 404, which are coaxial with the rotor shaft 406, and at least one radial bar 410, that fixes the rings 404 relative to each other, and that are attached to the wall of the housing, whereby the flow passages 402 are defined by the rings and the bar. According to an embodiment shown in FIGS. 9D and 9E, the flow-restraining disk 400 may also comprise channels 412 for distribution of the chemical medium on the down-stream side of the rotor body, directed in the opposite flow direction F from the pulp suspension. Suitably, the chemical supply 413 to the channels 412 is provided by means of a radial extending connection pipe 414 in the disk.

Figure 10A:
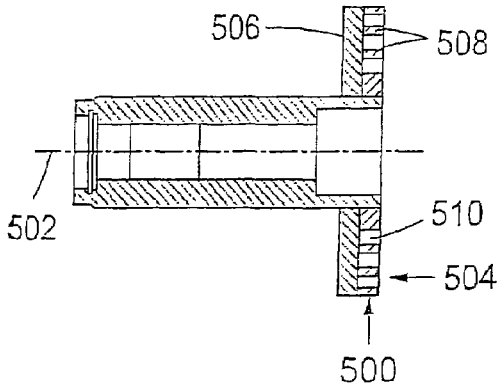
FIG. 10A is a side, elevational, cross-sectional view of one flow-restraining disk integrated with the rotor shaft according to the present invention.
Figure 10B:
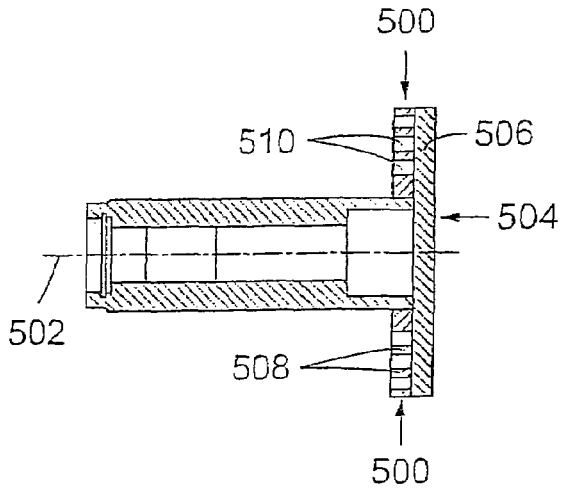
FIG. 10B is a side, elevational, cross-sectional view of another flow-restraining disk integrated with the rotor shaft according to the present invention.
Figure 10C:
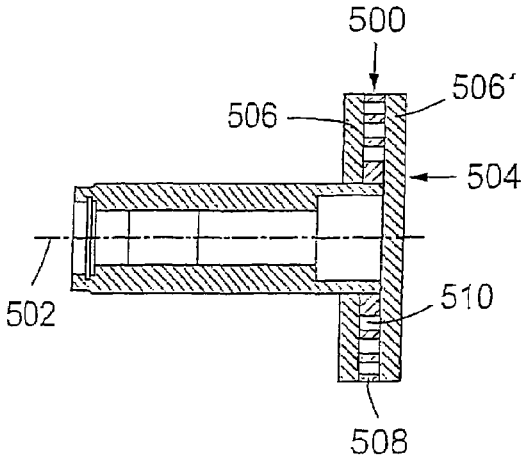
FIG. 10C is a side, elevational, cross-sectional view of another flow-restraining disk integrated with the rotor shaft according to the present invention.
Figure 10D:
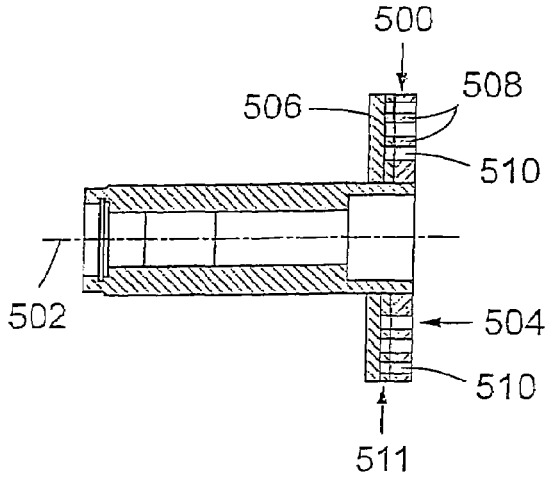
FIG. 10D is a side, elevational, cross-sectional view of another flow-restraining disk integrated with the rotor shaft according to the present invention.

However, a flow-restraining disk 500 can be integrated with the rotor shaft 502. FIGS. 10A-D illustrates alternative embodiments of flow-restraining disks 500 integrated with the rotor shaft 502. The rotor body 504 may suitably comprise a number of rotor pins 506, which extend from the rotor shaft 502, whereby the disk is fixed to the rotor pins 506 on the down-stream side of the rotor body, as shown in FIG. 10A, or on its up-stream side, as shown in FIG. 10B. As shown in FIG. 10C, the rotor body may comprise an additional number of pins 506', that extend from the rotor shaft on the down-stream side of the disk, whereby the disk 500 is also fixed to the additional pins 506'. Preferably, the disk comprises a number of concentrical rings 508, which are coaxial with the rotor shaft, and the rotor pins 506, 506' fix the rings 508 in relation to each other, whereby flow passages 510 are defined by the pins and the rings. FIG. 10D shows rotor pins 506 and concentrical rings 500. Further, spacer elements 511 are arranged between the rotor pins 506 and the concentrical rings 500. The spacer elements are used in order to move the turbulent zone.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for mixing of a chemical medium in gaseous or liquid state with a pulp suspension, comprising a housing having a wall that defines a mixing chamber, a first feeder for feeding the pulp suspension to the mixing chamber, a rotor shaft that extends in the mixing chamber, a drive device for rotation of the rotor shaft, a rotor body that is connected to the rotor shaft and arranged to supply kinetic energy to the pulp suspension flow during rotation of the rotor shaft by the rotation of the drive device, such that turbulence is produced in a turbulent flow zone in the mixing chamber, a second feeder for feeding the chemical medium to the mixing chamber, an outlet for discharging the mixture of chemical medium and pulp suspension from the mixing chamber, a flow-restraining disk in the outlet from the mixing chamber with one or more flow passages arranged to temporarily increase the flow velocity of the pulp suspension when the pulp suspension passes the flow-restraining disk, the second feeder comprising a chemical distribution element integrated with the rotor body and arranged to distribute the chemical medium to within a close vicinity of said turbulent flow zone and said rotor body comprising a number of rotor pins which extend from the rotor shaft on the upstream side of the flow-restraining disk.

2. Apparatus according to claim 1, wherein said chemical distribution element comprises at least one chemical outlet situated upstream of the rotor pins.

3. Apparatus according to claim 2, wherein said chemical distribution element comprises at least one distribution pipe that extends radially from the rotor shaft, whereby the chemical outlet is arranged on the distribution pipe.

4. Apparatus according to claim 2, wherein said second feeder comprises a stationary cylindrical body which is coaxial with the rotor shaft, and wherein said rotor body comprises a sleeve that sealingly surrounds the cylindrical body, whereby the cylindrical body is provided with a channel for the chemical medium that communicates with the chemical distribution element.

5. Apparatus according to claim 1, wherein said chemical distribution element comprises at least one chemical outlet arranged on at least one of the rotor pins.

6. Apparatus according to claim 1, wherein said chemical distribution element comprises a plurality of chemical outlets arranged on at least one of the rotor pins, whereby at least one chemical outlet is directed in the opposite flow direction of the pulp suspension along the rotor shaft and at least one chemical outlet is directed radially outward form the rotor shaft.

7. Apparatus according to claim 1, wherein each rotor pin is curved forwardly from the rotor shaft or backwardly relative to the rotational direction of the rotor body.

8. Apparatus according to claim 1, wherein each rotor pin has a width as seen in the rotational direction of the rotor body that increases along at least a part of the rotor body in a direction against the rotor shaft.

9. Apparatus according to claim 1, wherein said rotor shaft is provided with an axially flow generating element.

10. Apparatus according to claim 9, wherein said axial flow-generating element comprises a number of blades which are obliquely attached relative to the rotor shaft.

11. Apparatus according to claim 9, wherein said axial flow-generating element comprises a screw thread or a band thread which extends along the rotor shaft.

12. Apparatus according to claim 1, wherein each flow passage extends obliquely from the upstream side of the disk against the center shaft of the disk.

13. Apparatus according to claim 1, wherein the disk is stationarily arranged in the housing.

14. Apparatus according to claim 13, wherein said flow-restraining disk comprises channels for distribution of the chemical medium on the downstream side of the rotor body.

15. Apparatus according to claim 13, wherein said disk comprises a number of concentric rings which are coaxial with the rotor shaft and at least one radial bar that fixates the rings relative to each other and that are attached in the wall of the housing, whereby the flow passages are defined by the rings and the bar.

16. Apparatus according to claim 1, wherein said disk is integrated with the rotor shaft.

17. Apparatus according to claim 16, wherein said rotor body comprises a number of pins that extend from the rotor shaft, whereby the disk is fixed to the pins on the downstream side of the rotor body.

18. Apparatus according to claim 17, wherein said rotor body comprises an additional number of pins that extend from the rotor shaft on the downstream side of the disk, whereby the disk is also fixed to said additional pins.

19. Apparatus according to claim 17, wherein said disk comprises a number of concentric rings which are coaxial with the rotor shaft and the rotor pins fixate the rings in relation to each other, whereby flow passages are defined by the pins and the rings.

20. Apparatus according to claim 16, including spacer elements arranged between the disk and the rotor pins.

* * * * *